US009441281B2

(12) United States Patent
Taulavuori et al.

(10) Patent No.: US 9,441,281 B2
(45) Date of Patent: Sep. 13, 2016

(54) METHOD FOR MANUFACTURING AN AUSTENITIC STEEL OBJECT

(75) Inventors: Tero Taulavuori, Tornio (FI); Antero Kyröläinen, Pattijoki (FI); Terho Torvinen, Kokkola (FI)

(73) Assignee: OUTOKUMPU OYJ, Helsinki (FI)

( * ) Notice: Subject to any disclaimer, the term of this patent is extended or adjusted under 35 U.S.C. 154(b) by 1140 days.

(21) Appl. No.: 12/523,156

(22) PCT Filed: Jan. 15, 2008

(86) PCT No.: PCT/FI2008/050007
§ 371 (c)(1),
(2), (4) Date: Jul. 14, 2009

(87) PCT Pub. No.: WO2008/087249
PCT Pub. Date: Jul. 24, 2008

(65) Prior Publication Data

US 2009/0314394 A1 Dec. 24, 2009

(30) Foreign Application Priority Data

Jan. 17, 2007 (FI) ..... 20070038

(51) Int. Cl.

| | |
|---|---|
| ***C21D 1/26*** | (2006.01) |
| ***C21D 1/18*** | (2006.01) |
| ***C21D 8/02*** | (2006.01) |
| ***C21D 9/50*** | (2006.01) |
| ***C21D 9/52*** | (2006.01) |
| ***C22C 38/04*** | (2006.01) |
| ***C22C 38/40*** | (2006.01) |

(52) U.S. Cl.
CPC . *C21D 1/26* (2013.01); *C21D 1/18* (2013.01); *C21D 8/0205* (2013.01); *C21D 9/50* (2013.01); *C21D 9/52* (2013.01); *C22C 38/04* (2013.01); *C22C 38/40* (2013.01)

(58) Field of Classification Search
CPC ..... C21D 1/18; C21D 1/19; C21D 1/26; C21D 8/0205; C21D 9/52; C22C 38/04; C22C 38/38; C22C 38/40; C22C 38/58
USPC ..... 148/333, 336, 337, 610; 420/34, 44, 56
See application file for complete search history.

(56) References Cited

U.S. PATENT DOCUMENTS

| | | | | |
|---|---|---|---|---|
| 3,619,535 | A | 11/1971 | Sullivan | |
| 3,904,446 | A | 9/1975 | Uchida et al. | |
| 5,080,727 | A | 1/1992 | Aihara et al. | |
| 5,171,384 | A | 12/1992 | Igawa et al. | |
| 5,269,856 | A | 12/1993 | Igawa et al. | |
| 5,494,537 | A | 2/1996 | Miyakusu et al. | |
| 6,880,220 | B2 | 4/2005 | Gandy | |
| 2002/0102178 | A1 | 8/2002 | Hiramatsu | |
| 2004/0230166 | A1* | 11/2004 | Hill et al. | 604/273 |

FOREIGN PATENT DOCUMENTS

| | | | |
|---|---|---|---|
| GB | 2308385 | A | 6/1997 |
| JP | 2003193202 | A * | 7/2003 |

OTHER PUBLICATIONS

Tomimura et al., English machine translation of JP 2003-193202, Jul. 2003, whole document.*

* cited by examiner

*Primary Examiner* — Roy King
*Assistant Examiner* — Caitlin Kiechle
(74) *Attorney, Agent, or Firm* — Chernoff, Vilhauer, McClung & Stenzel, LLP

(57) ABSTRACT

The invention relates to a method for manufacturing a ductile, high strength austenitic stainless steel object from an austenitic stainless, steel strip, in which method the strip is cold worked in order to promote the formation of martensite into the microstructure of the strip, and the strip having a dual-phase microstructure is further processed. The strip is then shaped to a desired object having at least one curved or arcuate area and during the shaping of the object the different areas of the strip are deformed in different degrees. The desired object is further reversion annealed in order to reverse martensite back to the austenite form and a hardening effect is achieved in order to have an essentially fine grain microstructure for at least the curved or arcuate area of the object.

16 Claims, No Drawings

METHOD FOR MANUFACTURING AN AUSTENITIC STEEL OBJECT

This is a national stage application filed under 35 USC 371 based on International Application No. PCT/FI2008/050007 filed Jan. 15, 2008, and claims priority under 35 USC 119 of Finnish Patent Application No. 20070038 filed Jan. 17, 2007.

The invention relates to a method for manufacturing a ductile, high strength austenitic stainless steel object, in which method the mechanical properties of the object is improved in at least one stage heat treatment.

The high deformation and brief annealing of the austenitic stainless steels enable formation of a fine-grained martensitic and austenitic grain structure, which enables excellent mechanical properties with a high strength and ductility. This phenomenon is described for instance in Somani M. C. et al, Microstructure and mechanical properties of reversion-annealed cold-rolled 17Cr-7Ni type austenitic steels, presented at Stainless Steel '05. 5th European Congress Stainless Steel Science and Market, Seville, Spain, Sep. 27-30, 2005, pp. 37-42. According to this documentation austenitic steel strips are cold-rolled and this cold-rolling promotes the formation of martensite. The brief in-line annealing treatment at the temperature above 700° C. enables formation of the dual-phase microstructure of ductile martensite and ultra-fine austenite. Even for a cold-rolling reduction of 35-45% ultra-fine austenite is readily obtained. With the dual-phase microstructure the yield strength of 1000 MPa and the total elongation of 36% is achieved.

The JP patent application 04-063247 describes a high strength and high ductility stainless steel, which is cold-rolled as a phase transformation treatment into a martensite single-phase microstructure. Thereafter, the steel is subjected to a heat treatment at the temperature range of 600 to 900° C. to form the microstructure into austenite single phase or into a mixed phase of austenite and martensite. Then the steel is again subjected to martensite transformation treatment and the subjected to a heat treatment at the temperature range of 600 to 900° C. Thus the microstructure made of an austenite single phase of a mixed phase of austenite and martensite is formed and has fine grains which grain size is at the maximum of 1 micrometer.

The JP patent application 07-216451 describes a production of stainless steel having welding softening resistance, high strength and high ductility. The steel has a dual phase microstructure consisting of martensitic phase and austenitic phase. After giving a deformation of 3% or less, a heat treatment is carried at the temperature range of 400-600° C. for 30 or less minutes. Then the 0.2% proof stress is more than 900 $N/mm^2$.

The references describe the results from tests for flat products, such as plates, sheets or strips and, therefore, the distribution of values for properties is essentially uniform for the whole object treated.

The object of the present invention is to achieve an improved method for manufacturing an austenitic stainless steel object, which has an at least partially curved internal and/or external shape, and which object is handled in at least one stage heat treatment for good mechanical properties of ductility and high strength. The essential features of the present invention are enlisted in the appended claims.

In accordance with the present invention an austenitic stainless steel strip is first cold worked, advantageously by rolling for promoting the formation of martensite phase in the microstructure, which formation of martensite is to be known beneficial for the desired mechanical properties of ductility and high strength. After cold working, the steel strip is shaped into a desired object, which has at least one area with a curved or arcuate external and/or internal shape. The shaped object is further reversion annealed in order to reverse martensite back to the austenite and in order to achieve fine and ductile grain structure for at least the curved or arcuate area of the object. Further, a hardening effect is achieved for the object during the reversion annealing and/or after the reversion annealing as a separate stage. The hardening effect is carried out by work hardening and/or by bake hardening. When the bake hardening is used the bake hardening enhances the strain ageing and increases the strength of the object also in these areas where the effect of the reversion annealing is smaller.

The raw material for the strip to be treated in accordance with the method of the invention is an austenitic stainless steel containing as the main components in addition to iron 15-22% by weight chromium, 1-10% by weight nickel and 0.5-20% by weight manganese and 0.01-0.1% by weight carbon, advantageously 0.01-0.05% by weight carbon.

The austenitic stainless steel strip is advantageously roll formed into a desired object, but the shaping can also be done for instance by bending. The shape of the object can, when seen from the cross-section in the longitudinal direction, be circular, oval, square, rectangular or a combination of at least two of these shapes or some other geometry so that the shape is at least partly curved or arcuate. A tube is one preferable shape of the object, but other shapes of the object are also preferable. The closed shape in the longitudinal direction for the object is preferably achieved by welding, but any other mechanical joining methods can be used. The object can also in its longitudinal direction be at least partly open. Further, the object can have at least two at least partly curved or arcuate areas next to each other in the longitudinal direction or adjacent to each other in the transversal direction, which areas are connected to each other by an essentially flat portion in a horizontal or vertical or inclined position the connected areas.

In accordance with the invention, the austenitic stainless steel strip is first cold rolled in order to promote the formation of the martensite phase in the microstructure. The rolling reduction degree is between 5-50%, advantageously between 10-30%. After rolling the portion of martensite in the strip is between 10-50%, advantageously between 15-35%, and the rest is the deformed austenite phase. The cold rolled dual-phase steel strip is then shaped into the form of the desired object, which is externally and/or internally at least partly curved or arcuate. During the shaping of the object the different areas of the strip are deformed in different reduction degrees and the martensite content is proportional to the reduction degree. For instance, if the shaped object is a tube, the internal areas of tube are more deformed than the external areas of the tube and in the case, where the cross-section of the object when seen from the longitudinal direction is square, the corners of the square object are more deformed than the straight areas of the square object. The more deformed areas of the object having martensite content 30-60%, advantageously 40-50% are further work hardened. The less deformed areas of the object having martensite less than 30% are subjected to a bake hardening either during the reversion annealing or during a separate bake annealing treatment after the reversion annealing. In a case the separate bake annealing treatment is preferable carried out, the treatment is achieved for the whole object itself. The separate bake annealing ensures the bake hardening and essentially uniform mechanical properties across the cross-section of the object when needed.

The reversion annealing for the shaped object from the induced martensite back to austenite is carried out at the temperature range of 500-900° C., advantageously at 700-800° C. for 5-60 seconds, advantageously 10-20 seconds. The separate bake annealing treatment is preferably carried out in the cooling stage of the reversion annealing at the temperature range of 100-450° C. for 1-60 minutes, advantageously at the temperature range of 150-250° C. for 5-20 minutes and more advantageously at the temperature range of 160-200° C. for 10-15 minutes. The separate bake annealing treatment can be carried out also after the reversion annealed object is first cooled to the room temperature and then heated to the desired temperature for bake hardening.

EXAMPLE 1

A strip made of austenitic stainless steel grade 1.4318 (AISI 301 LN) containing as the main components 17.7% by weight chromium and 6.5% by weight nickel and 0.02% by weight carbon in addition to iron was processed in accordance with the invention for achieving an improved ductility and high strength. The austenitic strip was first cold-rolled using the reduction degree of 15% in order to form martensite so that the microstructure of the strip is a dual-phase containing about 30% martensite and the rest austenite.

The dual-phase strip was further rolled into a shape of a tube so that the opposed edges of the strip are connected to each other by welding. Thus the tube for further processing according to the invention has at least one area, which is externally and internally curved or arcuate. The tube containing a dual phase microstructure is transferred into a reversion annealing at the temperature of 700° C. with the annealing time of 10 seconds. After this reversion annealing the more deformed areas of the tube have a fine-grained, tight and ductile microstructure and the yield stress reaches the level of 1000-1200 MPa.

Optionally, the reversion annealed tube is subjected to a bake annealing at the temperature 170° C. for 10 minutes in order to improve the properties of the less deformed areas of the tube when the yield stress reaches the level of 1000-1200 MPa.

EXAMPLE 2

A stainless steel strip having a chemical composition containing 17.5% by weight chromium, 6.5% by weight nickel, 1.11% by weight manganese, 0.14% by weight nitrogen and 0.026% by weight carbon and the balance iron and unspecified impurities was cold worked by rolling with a thickness reduction of 9%. At this stage the original yield strength increased from 360 MPa to 650 MPa. The elongation to fracture of the cold worked material was $A_{50}$=32%.

The cold worked strip was shaped to a hollow section having a rectangular cross-section in longitudinal direction and the local deformations made the object partially martensitic. The martensite fractions measured were 3-50% depending of the local deformation obtained. The highest deformation and martensite fractions were present on the corners of the hollow section.

The rapid heat-treating at the temperature of 850° C. in 1 second was sufficient for a martensite-austenite reversion in order to recover the mechanical properties. The final yield strength of 980 MPa and elongation to fracture $A_{10}$=42% was achieved in the most deformed corners of the object.

By adjusting the heat treatment properly the less deformed parts of the hollow section were bake annealed simultaneously with the reversion annealing. These parts of the object had a temperature below 450° C. and a strength increase was obtained. In this case a separate bake hardening was not seen as a necessary, but when even better mechanical properties are desired a separate bake hardening at 170° C. could be used.

The invention claimed is:

1. Method for manufacturing a ductile austenitic stainless steel object from an austenitic stainless steel strip, comprising:

cold working the strip in order to promote formation of martensite in the microstructure of the strip, whereby the cold-worked strip has a dual-phase microstructure, shaping the strip to form an object, which when viewed in its longitudinal direction, being at least partly open and having at least one curved or arcuate area, whereby a first region of the strip is deformed to a greater degree than a second region and is work hardened, heating the shaped object in order to both reversion anneal the shaped object, to reverse martensite back to austenite and achieve a fine grain microstructure for at least the first region of the strip, and bake harden the second region of the strip, whereby both regions of the strip are hardened.

2. Method according to claim 1, wherein the heating step comprises heating the shaped object at a temperature range from 500-900° C. for 5-60 seconds for reversion annealing.

3. Method according to claim 2, wherein the heating step comprises heating the shaped object at a temperature range from 700-800° C. for 10-20 seconds for reversion annealing.

4. Method according to claim 1, wherein the wherein the heating step comprises heating the shaped object for reversion annealing followed by baking the shaped object for bake hardening.

5. Method according to claim 4, comprising baking the shaped object at a temperature range of 100-450° C. for 1-60 minutes.

6. Method according to claim 4, comprising baking the shaped object at a temperature range of 150-250° C. for 5-20 minutes.

7. Method according to claim 4, comprising baking the shaped object at a temperature range of 160-200° C. for 10-15 minutes.

8. Method according to claim 4, comprising allowing the shaped object to cool after the reversion annealing and interrupting the cooling by baking the shaped object at a temperature range of 100-450° C. for 1-60 minutes.

9. Method according to claim 4, comprising allowing the shaped object to cool to room temperature after the reversion annealing and subsequently baking the shaped object at a temperature range of 100-450° C. for 1-60 minutes.

10. Method according to claim 1, wherein the shaped object is circular in cross-section in the longitudinal direction.

11. Method according to claim 1, wherein the shaped object is oval in cross-section in the longitudinal direction.

12. Method according to claim 1, wherein the shaped object is square in cross-section in the longitudinal direction.

13. Method according to claim 1, wherein the shaped object is rectangular in cross-section in the longitudinal direction.

14. Method according to claim 1, wherein the cross-section of the object in the longitudinal direction is a combination of at least two of the shapes containing circular, oval, square or rectangular shape.

15. Method according to claim 1, wherein the strip material contains as the main components in addition to iron, 15-22% by weight chromium, 1-10% by weight nickel, 0.5-20% by weight manganese and 0.01-0.1% by weight carbon.

16. Method according to claim 1, wherein the strip material contains as the main components in addition to iron, 15-22% by weight chromium, 1-10% by weight nickel, 0.5-20% by weight manganese, and 0.01-0.05% by weight carbon.

* * * * *